United States Patent [19]

Speckhart

[11] Patent Number: 4,592,313

[45] Date of Patent: Jun. 3, 1986

[54] PNEUMATIC VALVE RETURN

[76] Inventor: Frank H. Speckhart, 513 Dellwood Dr., Knoxville, Tenn. 37917

[21] Appl. No.: 661,141

[22] Filed: Oct. 15, 1984

[51] Int. Cl.[4] ..... F01L 9/02

[52] U.S. Cl. ..... 123/90.14; 123/90.24; 123/90.65

[58] Field of Search ..... 123/90.14, 90.65, 90.12, 123/90.13, 90.24

[56] References Cited

U.S. PATENT DOCUMENTS

| | | | |
|---|---|---|---|
| 1,474,794 | 11/1923 | Shepherd | 123/90.14 |
| 3,120,221 | 2/1964 | Lyons | 123/90.14 |
| 3,722,483 | 3/1973 | Overby | 123/90.14 |

FOREIGN PATENT DOCUMENTS

| | | | |
|---|---|---|---|
| 2364328 | 5/1978 | France | 123/90.14 |
| 2537207 | 6/1984 | France | 123/90.14 |
| 2102065 | 1/1983 | United Kingdom | 123/90.14 |

*Primary Examiner*—Ira S. Lazarus
*Attorney, Agent, or Firm*—Luedeka & Neely

[57] ABSTRACT

A pneumatic valve return is disclosed for a cam-operated intake or exhaust valve of an internal combustion engine having a valve stem extending out of a cylinder head of the engine. The pneumatic valve return of the present invention provides a force acting to close the valve and operates to increase the force as the valve is opened. The pneumatic valve return includes a piston attached to the valve stem which is slidably fitted in a cylinder supported on the cylinder head about the valve stem. A chamber is thereby provided which is supplied with pressurized gas through a supply conduit to act on the piston to provide the closing force. A restriction in the supply conduit prevents rapid fluid escape from the chamber and, additionally, the supply conduct is isolated from the chamber to further prevent fluid escape when the valve has been partially opened by the actuation mechanism.

19 Claims, 4 Drawing Figures

PNEUMATIC VALVE RETURN

The present invention relates to an internal combustion engine and more particularly relates to a pneumatic valve return for use in an internal combustion engine having cam-operated intake and exhaust valves.

Generally, internal combustion engines with reciprocating pistons employ intake and exhaust valves operated by an actuation mechanism driven by a cam shaft. A typical valve has a valve head for engaging a seat in the cylinder head and a valve stem which extends through the cylinder head to be engaged and reciprocated by the actuation mechanism to open and close the valve. Although there are various types of cam-driven actuation mechanisms, e.g. push rod and rocker arm linkages and various overhead cam arrangements, generally, most actuation mechanisms open the valve against the closing action of a mechanical spring. The spring then operates to close the valve when the actuation mechanism no longer holds the valve open. Typically, valve springs are metal coil springs which are attached to the top of the valve stem and rest on the cylinder head about the valve stem.

There are various problems associated with the use of mechanical valve springs, particularly in high rpm engines such as racing engines. At high rpms, the valve spring must operate extremely quickly to close the valve and to insure that the various linkages in the actuation mechanism stay in contact. If the linkages are not kept in engagement, the movement of the actuation mechanism will not follow the shape of the cam and inefficient operation may result. In the worst case where the valve does not fully close, a condition known as floating of the valves occurs which causes a drastic decrease in engine efficiency and horse power. While this problem can be minimized by decreasing the mass of the linkage in the actuation mechanism between the valve and the cam shaft, it has been found that mechanical springs are not entirely effective in extremely high speed engines (up to 12,000 rpm). It is believed that "surge" or the resonant vibration of the spring inherently places limitations on mechanical springs due to a surge wave which is generated by the sudden compression of the spring. Not only does surge prevent the spring from operating as intended to close the valve but also, stress may be caused which may cause the springs to break. While these effects may be minimized somewhat by employing complicated damper mechanisms, or by using expensive variable pitch or compound springs, surge can not be entirely eliminated. There are also other inherent problems with mechanical springs such as the deterioration of the spring due to the constant heat from the engine.

Various attempts have been made to develop pneumatic valve return devices for replacing mechanical springs in a cam operated valve mechanism. Generally, these pneumatic devices are complicated, require modification or replacement of the cylinder head and are not effective. In addition, known pneumatic return devices for valves are generally not adjustable for different operating conditions.

It is accordingly an object of the present invention to provide a pneumatic valve return for intake in exhaust valves in internal combustion engines. It is a further object to provide a pneumatic valve return in which the force acting to close the valve increases as the valve is opened. It is another object of the present invention to provide a pneumatic valve return which is fully and quickly adjustable for variable operating conditions. It is another object of the present invention to provide a pneumatic valve return which is usable in connection with conventional engines without modification of the cylinder head and which is easily installed.

These and other objects will become more fully apparent as the following description is read in conjunction with the drawings in which.

The present invention provides a pneumatic valve return for an internal combustion engine having a cylinder head with intake and exhaust valves, each valve having a valve head for engaging a valve seat in the cylinder head and a valve stem extending out of the cylinder head. The valves are operated by an actuation mechanism where the valve stem is moved inwardly into the cylinder head to open the valve. The pneumatic valve return of the present invention exerts a force on the valve stem to close the valve and operates to increase the force as the valve is opened.

Generally, one form of the pneumatic valve return of the present invention includes a valve return cylinder having a cylindrical bore generally centered about the valve stem with the return cylinder being supported at a support end by the cylinder head. The valve return cylinder has an opposing access end for providing access into the bore. A valve return piston is slidably and sealably fitted in the bore of the cylinder and is attached to the valve stem. The piston in the cylinder defines a chamber between the piston and the support end of the cylinder and a conduit is provided for introducing a supply of pressurized gas into the chamber which has a restriction for preventing rapid gas escape from the chamber. The pressurized gas introduced into the chamber applies a force to the piston to urge the valve to the closed position and, because of the restriction in the conduit means, the pressure in the chamber is increased and the closing force is increased as the cam mechanism opens the valve.

In accordance with another aspect of the present invention, a recess in the support end of the cylinder receives the valve guide and maintains the cylindrical bore centered about the valve stem.

In accordance with another aspect of the present invention the pneumatic valve return includes an oil collector on the exterior of the cylinder and an oil passageway for lubricating the valve stem at the valve guide.

Figure 1:
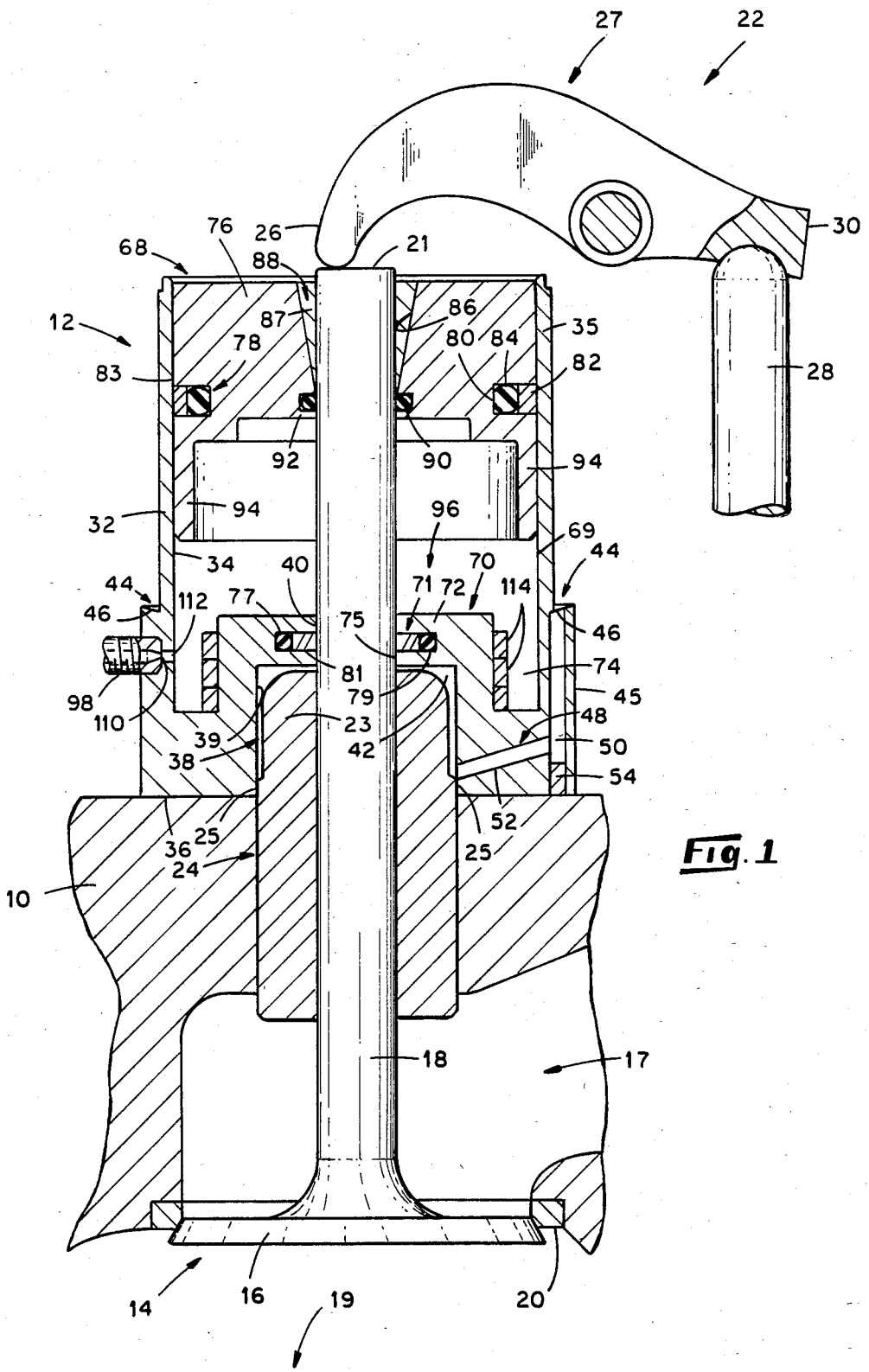
FIG. 1 is a partially broken away, cross-sectional view of a cylinder head of an internal combustion engine showing a valve and a preferred form of the pneumatic valve return of the present invention.
Figure 2:
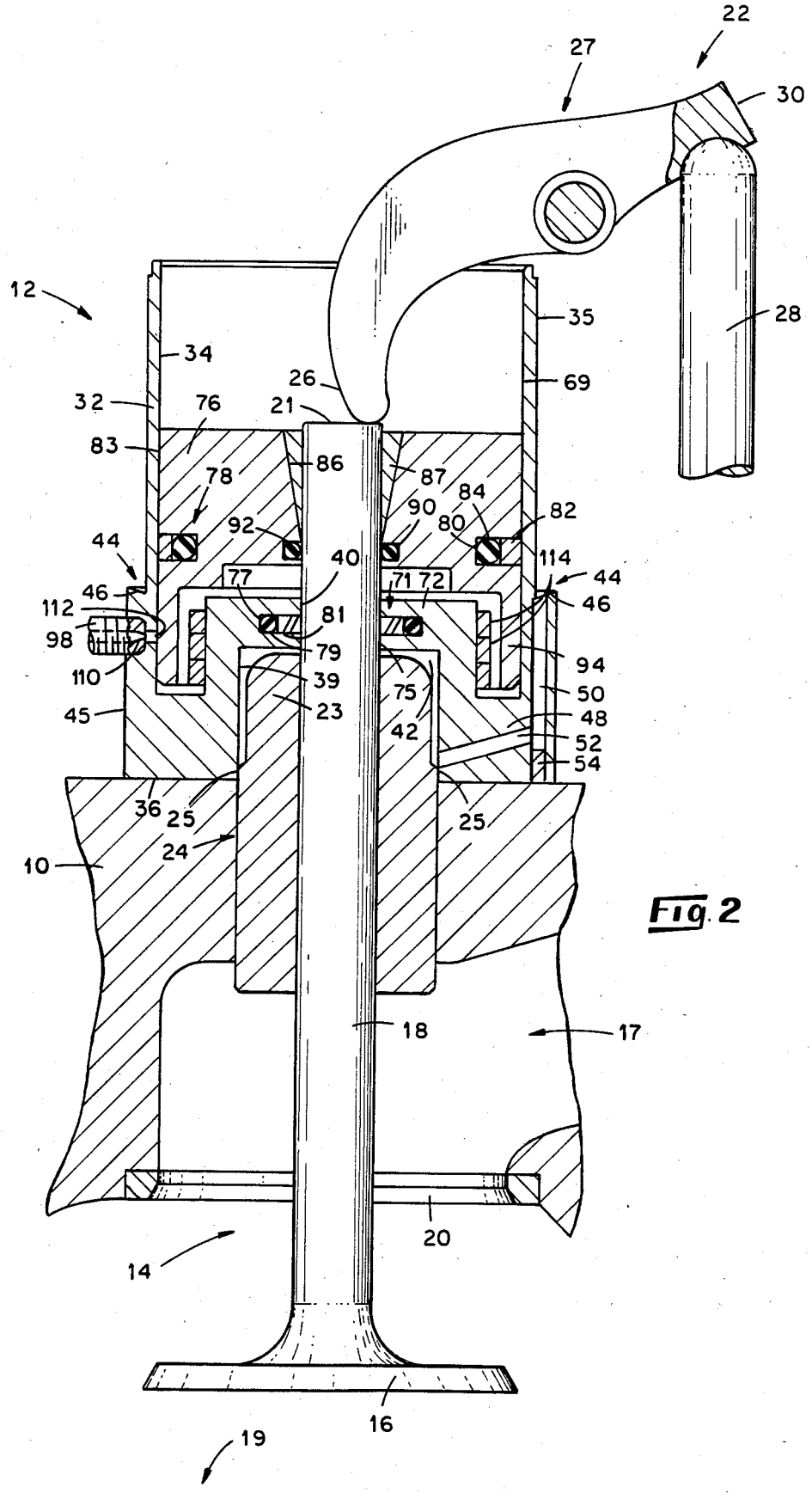
FIG. 2 is a partially broken away, cross-sectional view as shown in FIG. 1 with the valve shown in the open condition.

Referring now to the drawings in which like reference characters designate like or corresponding parts throughout the several views, there is shown in FIGS. 1 and 2 a portion of a cylinder head 10 of an internal combustion engine, a valve 14, and one form of the pneumatic valve return 12 of the present invention. As shown, the valve 14 depicted is intended to represent either an exhaust or an intake valve for closing a port 17 into a combustion chamber 19 of the engine. The valve 14 has a valve head 16 for matingly engaging a valve seat 20 to close the valve. A valve stem 18 is attached to the valve head 16 and extends through the cylinder head 10 upwardly to an engagement surface 21 at the top of the valve stem 18.

The valve stem 18 is supported for reciprocating motion by a valve guide 24 which extends through the cylinder head 10 to the port 17. The valve guide is of the type having an upper portion 23 with a cylindrical wall 25 which extends upwardly from the cylinder head 10 and the wall 25 is coaxial with the valve stem 18. An actuation mechanism 22, driven by a cam shaft (not shown), is operable to move the valve stem 18 from a closed position as shown in FIG. 1 with the valve head 16 engaging the valve seat 20 to an open position shown in FIG. 2 where the valve head 16 is spaced apart from the valve seat 20. The actuation mechanism 22 also controls the movement of the valve as it moves between the open and closed positions as determined by the shape of a cam on the cam shaft.

The actuation mechanism 22 depicted includes a rocker arm 27 having a valve engagement finger 26 for contacting the engagement surface 21 of the valve stem 18. The rocker arm 27 is mounted for pivotal movement and is contacted by a push rod 28 at an opposite push rod end 30. The push rod 28 is mechanically linked to the cam shaft in a known manner. While a push rod and rocker arm actuation mechanism is depicted, the pneumatic valve return 12 of the present invention may be employed with other types of actuation mechanisms such as the various types of overhead cam arrangements as are known in the art.

Referring still to FIGS. 1 and 2, the pneumatic valve return 12 of the present invention is shown to include a valve return cylinder 32 providing a cylindrical bore 34 and is positioned on the cylinder head 10 above the valve 14. As depicted, the valve return cylinder 32 is preferably a body of approximately the same dimensions as a conventional valve spring and thus has a generally cylindrically shaped exterior and thin walls 35 defining the cylindrical bore 34. The valve return cylinder has a support end 36 which is supported by the cylinder head 10 and has a valve guide recess 38 in the support end 36 for receiving the upper portion 23 of the valve guide 24 and valve stem bore 40 in said support end 36 at said recess 38 for admitting the valve stem 18 into the cylindrical bore 34. The valve guide recess 38 receives the valve guide 24 so as to maintain the cylindrical bore 34 of the cylinder 32 in a position coaxial also with valve stem 18. Preferably, the recess 38 is cylindrical in shape and has a cylindrical recess wall 39 coaxial with the bore 34. When the cylinder is installed, it is preferable for the uppermost area of the wall 25 of the valve guide 24 to be machined to a smaller diameter as shown to provide a valve guide oil void 42 for supplying oil to the valve stem 18 at the top of the valve guide 24 while leaving a lower contact area of the cylindrical wall 25 of the valve guide 24 intact for contacting the cylinder 32 in the recess to maintain the bore 34 coaxial with the valve stem 18. The recess 38 is sufficiently deep so that the oil void 42 extends over the top of the valve guide 24 to the valve stem 18.

An oil collector 44 is provided on the outside of the cylinder for collecting engine oil for lubricating the valve stem 18. In the embodiment depicted in FIGS. 1 and 2, the collector 44 is in the form of an annular trough provided by an enlarged base 45 of the cylinder 32 with a downwardly and inwardly angled bevel 46 where the enlarged base 45 joins the remaining upper portion of the cylinder 35. A cylinder oil passageway 48 connects between the trough and the valve guide oil void 42. The collector 44 is positioned at an appropriate height above the support end 36 of the cylinder 32 as is desirable to provide sufficient head pressure for oil flow through the cylinder oil passageway 48 into the valve guide oil void 42 and to the valve stem 18 at the valve guide 24. In the embodiment shown in FIGS. 1 and 2 the cylinder oil passageway 48 is formed by a vertical oil bore 50 extending from the support end 36 of the cylinder 32 to the collector 44 and a downwardly angled and inwardly extending, intersecting oil bore 52 extending from the valve guide recess 38 to the vertical bore 50. A plug 54 is preferably inserted in the lower end of the vertical bore to prevent oil leakage between the support end 36 and the cylinder head 10.

Figure 4:
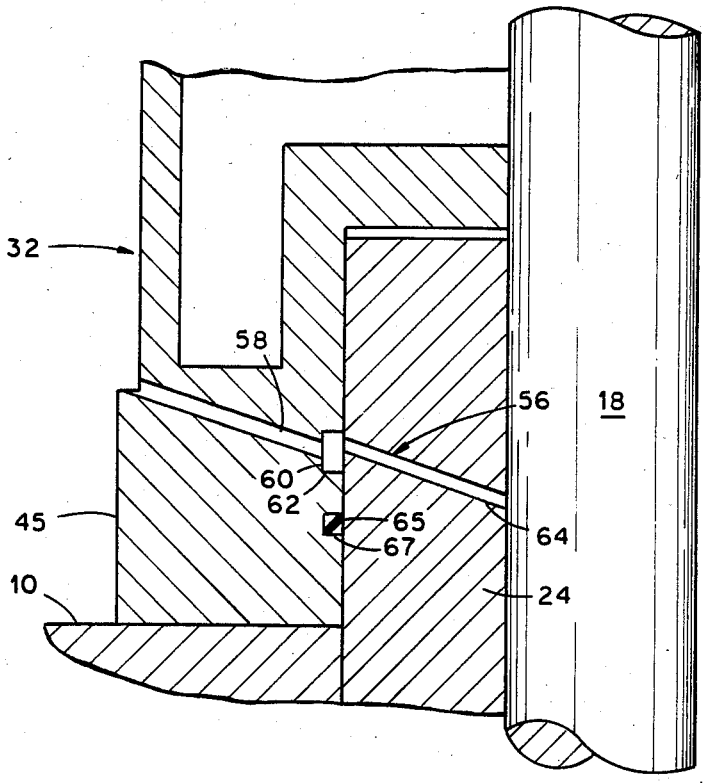
FIG. 4 is a partially broken away cross-sectional view of an alternate embodiment of the pneumatic valve return of the present invention.

An alternate embodiment of the present invention for supplying oil to the valve stem 18 is shown in FIG. 4. Again an enlarged base 45 of the cylinder 32 provides an oil collector 44 for collecting oil, although at a lower position on the cylinder 32. A valve guide oil passageway 56 extends downwardly and inwardly from the oil collector 44 to the valve stem 18 at an interior portion of the valve guide 24. Preferably, the valve guide oil passageway 56 is provided by an inclined oil bore 58 which extends from the oil collector 44 downwardly and inwardly to an annular oil groove 60 formed in the recess wall 39 in the recess 38. The oil groove 60 provides an annular oil flow space 62. Preferably, a valve guide oil bore 64 extends downardly and inwardly into the valve guide 24 from the annular oil flow space 62 to the valve stem 18. In the embodiment shown in FIG. 4, only the valve guide oil bore 64 need be formed in the valve guide and it is not necessary to machine the upper portion 23 of the valve guide 24. The annular oil flow space 62 provides for oil flow without any particular angular orientation between the cylinder 32 and the valve guide 24. To prevent oil leakage, a valve guide oil seal 65, such as an O-ring is preferably provided about the valve guide 24 in an annular oil seal groove 67 formed in the recess wall 39 beneath the annular oil flow space 62.

Referring to FIGS. 1 and 2, the cylindrical bore 34 of the cylinder 32 is shown to begin at an upper access end 68 of the cylinder 32 and terminate inside the cylinder 32 adjacent the support end 36. The cylindrical bore 34 thus defines an cylindrical interior surface 69 and has a closed lower end 70 with the valve stem 18 extending into the cylindrical bore 34 at the center of the lower end 70. A valve stem seal 71 is provided about the valve stem 18 at the valve stem bore 40. The valve stem seal 71 permits the valve stem 18 to freely reciprocate and insures that the lower end of the bore is fluid tight around the valve stem 18. Preferably, the support end 36 at the bottom of the bore 34 has sufficient thickness to provide the valve stem bore 40 with a cylindrical wall 75 having sufficient thickness for an annular seal groove 77 in the cylindrical wall 75 to house the seal 71. The valve stem seal 71 is preferably provided by a two-component seal including an O-ring 79 for urging a seal 81 having a rectangular configuration in contact with the valve stem 18.

The closed lower end 70 of the bore 34 preferably has a return body protrusion 72 centered about the valve stem 18. The protrusion 72 provides an annular space 74 about the protrusion in the lower end of the cylindrical bore 34. The valve stem bore 40 and seal 71 are in effect elevated above cylinder head 10 at the recess 38. Most preferably, the valve guide 24 and the recess 38 extend into the support end 36 to occupy at least a portion of the interior of the protrusion 72 as is shown.

In FIGS. 1 and 2 the pneumatic valve return 12 is shown to include a valve return piston 76 which is slidably fitted into the bore 34 in the cylinder 32. The piston has a side wall 83 and clearance is provided between the side wall 83 and the interior surface 69 of the bore 34 to permit sliding motion for the piston 76. A suitable clearance has a range from about 0.002 to about 0.005 inches. To provide a seal between the side wall 83 of the piston 76 and the cylindrical interior surface 69 of the bore 34, a piston seal 78 is provided in an annular groove 80 in the side wall 83 of the piston. Preferably, a two-component seal is provided having an outer ring 82 with a rectangular cross-section and an inner O-ring 84 for the rectangular outer ring 82 in contact with the interior wall of the cylinder 32.

The piston has a valve stem attachment bore 86 for receiving the valve stem 18, for permitting a portion of the valve stem 18 and the engagement surface 21 to be exposed above the top of the piston 76 and for attaching the piston 76 to the valve stem 18. Preferably, the valve stem bore 86 is downwardly tapered and provides a tapered annular area 88 around the valve stem 18 when the valve stem 18 is inserted into the bore 86. The valve stem 18 is preferably secured to the piston 76 by a split-ring keeper 87. The split-ring keeper 87 includes two individual keeper halves which together are operable to matingly fit into the tapered annular area 88. There is sufficient clearance space between the halves so that the keeper 87 may be forcefully inserted into the tapered annular area 88 to secure the valve stem 18 to the piston 76. A static valve stem seal 90 is disposed in an annular seal groove 92 beneath the tapered annular area 88 to provide a seal between the valve stem 18 and the piston 76. An O-ring is a suitable seal for the static valve stem seal 90.

A piston skirt 94 is formed on the underside of the piston 76 to extend the side wall 83 of the piston downwardly. As shown in FIG. 2, the piston skirt is dimensioned to be received into the annular space 74 in the bore 34. The piston skirt 94 extends the side wall 94 of the piston 76 sufficiently far to provide stability for the piston 76 in the bore 34 and, since the piston skirt 94 is received into the annular space 74, the overall height of the pneumatic valve return 12 is decreased. In addition, the piston skirt 94 increases the lateral support provided by the piston 76 for the valve stem 18 at its upper end making it possible to employ a shorter valve guide 24. Preferably, the valve return piston 76 is made of a light weight metal such as an aluminum alloy in order to minimize the mass of the moving parts used in connection with the operation of the valve.

The piston 76 in the cylinder 32 defines an essentially fluid-tight chamber 96 between the piston 76 and the closed lower end 70 of the bore 34. A conduit 98 is connected to the cylinder 32 at an inlet 112 into the chamber 76.

Figure 3:
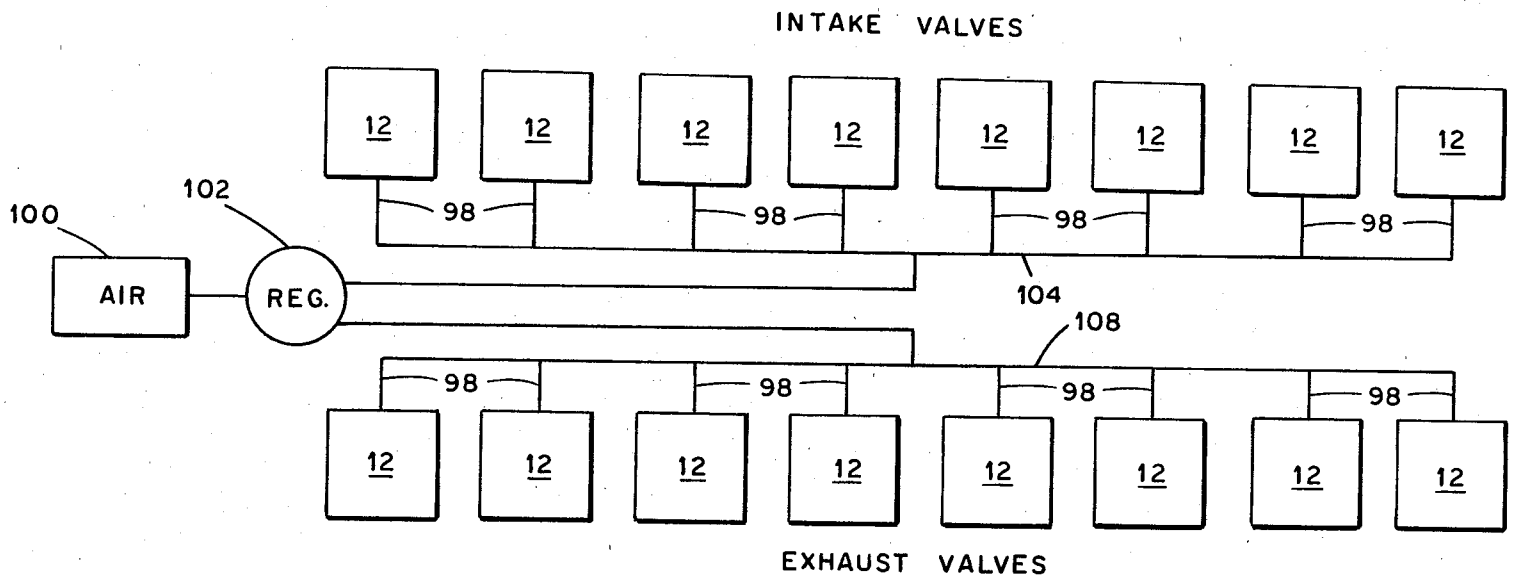
FIG. 3 is a diagrammatic view of the pressurized gas supply conduits for the pneumatic valve return of the present invention in a typical application.

As shown in FIG. 3 for a V-8 engine having eight intake valves and eight exhaust valves, the conduit 98 is connected to a source 100 of pressurized gas such as air as shown. For the intake valves, pressurized air is supplied to regulator 102 which is connected to an intake valve air supply manifold 104. The manifold 104 supplies air to each of the conduits 98 for each of the pneumatic valve returns 12 employed. Similarly, air from the regulator 102 supplies air to an exhaust valve air supply manifold 108. The manifold 108 supplied air to the conduit 98 for each of the pneumatic valve returns 12 for the exhaust valves.

As shown in FIGS. 1 and 2, a restriction 110 is formed in the conduit 98 adjacent to the inlet 112. The restriction 110 is dimensioned to provide air flow into the chamber 96 but has a sufficiently small flow area to prevent substantial quantities of pressurized air from escaping in response to sudden pressure changes in the chamber 96. The restriction 110 is adjacent to the inlet 112 so that the volume of the chamber 96 is not substantially increased by the volume in the conduit 98. If desired, the restriction may be formed in the cylinder body at or adjacent the inlet 112 into the chamber 96. It has been found that it is preferable for the ratio of the effective surface area of the piston 76 to the flow area of the restriction to be greater than 500:1, and preferably, greater than about 1500:1. For example in an embodiment of the present invention where the piston 76 has a diameter of about 1.37 inches, a suitable size for the restriction is about 0.030 inches (area ratio of approximately 2100:1).

The inlet 112 is positioned in said interior wall of said piston so that said inlet is covered by said piston 76 to isolate the conduit 98 when said valve is partially opened as shown in FIG. 2. Preferably, the inlet 112 is positioned to introduce pressured air into the annular space 74 in the lower end of the bore 34 and the inlet 112 is covered by the piston skirt when the piston 76 is moved to the position shown in FIG. 2.

In the operation of the pneumatic valve return 12 shown in the embodiments depicted, pressurized air supplied through conduit 98 operates to urge the piston 76 upwardly which exerts a closing force at all times on the valve stem 18 to urge the valve head 16 towards the valve seat 20. In every operating cycle of the valve 14, as the actuation mechanism 22 opens the valve 14, the valve stem 18 pulls the piston 76 downwardly into the bore 34 of the cylinder 32. When the valve stem 18 approaches the fully open position of FIG. 2, the piston skirt 94 closes the inlet 112 into the chamber 96. Because of the restriction in the conduit 98, substantial quantities of air cannot escape and the pressure is increased as the piston 76 moves downwardly. As the valve reaches the fully open position and the pressure approaches its maximum for the cycle, the piston skirt 94, by closing the inlet 112, prevents substantially all air escape from the chamber 96. When the actuation mechanism 22 no longer holds the valve open, the pressure in the chamber 96 operates to close the valve and to maintain the valve in the closed position until the actuation mechanism opens the valve again. Since small amounts of air do escape through the restriction 110 when the inlet 112 is not covered and some additional loss necessarily occurs though the various seals, air in the chamber 96 is replenished by air supplied the conduit 98 during the time when the valve is closed. Since the valve is closed longer than it is open during each cycle there is ample time for complete replenishment of the air in the chamber 96.

The pneumatic valve return of the present invention provides a "tight spring" which is operable to fully close the valve during each operating cycle even at extremely high engine rpms (up to 12,000). In addition, the pneumatic valve return is operable to keep the various parts of actuation mechanism in engagement (except for intended valve clearance when the valve is closed) so that the movements of the engagement mechanism are properly determined by the shape of the cam on the cam shaft. The air pressure supplied to the chamber 96 may be adjusted for various conditions and may be varied during operation of the engine with the pressure being increased at higher engine speed when a greater closing force is required.

The pneumatic valve return of the present invention is suitable for use in conventional engines as a replacement for conventional valve springs. After minor modification of the valve guide 24 for the embodiment as shown in FIGS. 1 and 2 or forming the valve guide oil bore 64 as for the embodiment as shown in FIG. 3, the pneumatic valve return is simply placed with the upper portion of the valve guide inserted in the valve guide recess 38. The bore 34 of the cylinder 32 of the pneumatic valve return 12 of the present invention is thus necessarily centered about the valve stem 18. Similar to conventional valve springs, the closing force of the pneumatic valve return 12, which in the present invention is provided by the air pressure in the chamber 96, is operable to hold the device in contact with the cylinder head 10 when the actuation mechanism 22 engages the valve stem 18. When the valve 14 is fully closed, the valve head 16 is held in contact with the seat 20 by the pneumatic valve return 12 which holds the pneumatic valve return 12 on the cylinder head 10.

The split-ring keeper 87 used the secure the piston 76 to the valve stem 18 is easily driven into the tapered annular area 88 with the piston positioned along the valve stem at a selected position to provide the appropriate size for the chamber 96. As shown in FIG. 2, the size of the chamber 96 may also be decreased as necessary by adding rings 114, preferably having rectangular cross-sections, which are friction-fitted about the protrusion 72 in the bore 34.

The pneumatic valve return 12 of the present invention provides for efficient lubrication for the valve stem 18 in the valve guide 24 without modification of the valve head and with only minor modification of the valve guide.

While preferred embodiments of the present invention have been shown and described, it will be understood that there is no intent to limit the invention by such disclosure, but rather, it is intended to cover all modifications and alternate embodiments falling within the spirit and scope of the invention as defined in the appended claims.

What is claimed is:

1. In a reciprocating piston internal combustion engine having a cylinder head and intake and exhaust valves operated by a cam-driven actuation mechanism, each valve having a valve head for engaging a valve seat in the cylinder head and a valve stem attached to the valve head and extending through and out of the cylinder head to be engaged by the actuation mechanism, the valve stem being supported for reciprocating motion by a valve guide in the cylinder head so that the valve is movable between a closed position with the valve head in contact with the valve seat and an open position with the valve head being spaced-apart from the valve seat and the valve stem being moved inwardly into the cylinder head by the actuation mechanism, the actuation mechanism operating each valve through a cycle in which the valve is in the closed position longer than it is in the open position, a pneumatic valve return comprising:

a valve return body having a cylindrical bore generally centered about the valve stem, said valve return body having a support end supported by said cylinder head and sealingly receiving said valve stem and having an opposing access end having an opening for providing access into said bore to permit the actuation mechanism to engage the valve stem;

a valve return piston slidably and sealably fitted in said cylindrical bore and being sealably attached to and being operable to move with said valve stem, said piston in said bore defining a chamber between said piston and said support end of said return body;

a source of pressurized gas at a selected pressure;

conduit means for introducing said pressurized gas into said chamber;

a restriction in said conduit means of sufficiently small size to prevent the escape of substantial quantities of gas from said chamber into said conduit means when said return piston moves in said bore as said valve stem is moved by the actuation mechanism, said conduit means supplying gas to said chamber through said restriction when the pressure of the gas in said chamber is less than said selected pressure; whereby said pressurized gas in said chamber yieldably exerts a force at all times on said piston to urge the valve to the closed position, the gas in said chamber is replenished when said valve is in the closed position to at least approximately said selected pressure, and said force is increased when the valve is moved toward the open position by the actuation mechanism causing the gas in said chamber to be compressed by said piston.

2. The pneumatic valve return of claim 1 wherein the ratio between the effective area of said piston and the flow area of said restriction is greater than about 500:1.

3. The apparatus of claim 1 further comprising means for substantially preventing all gas flow into said conduit when said valve has moved partially toward the open position.

4. The apparatus of claim 3 when said means for preventing gas flow into said conduit comprises a pressurized gas inlet into said chamber disposed in a position which will be blocked by said piston when said valve has been moved partially towards the open position to isolate said conduit from said chamber.

5. The pneumatic valve return of claim 1 further comprising means for collecting engine oil and a passageway for conveying the oil to said valve stem at said valve guide.

6. The pneumatic valve return of claim 5 wherein said oil collection means comprises a collection trough formed on the outside of said return body disposed above said valve stem to provide head pressure to induce fluid flow through said passageway means to said valve stem.

7. The pneumatic valve return of claim 6 wherein said passageway conveys the oil to the valve stem in the interior of said valve guide.

8. In a reciprocating piston internal combustion engine having a cylinder head and intake and exhaust valves operated by a cam-driven actuation mechanism, each valve having a valve head for engaging a valve seat in the cylinder head and a valve stem attached to the valve head and extending generally upwardly through and out of the cylinder head to be engaged by the actuation mechanism, the valve stem being supported for reciprocating motion by a valve guide in the cylinder head so that the valve is movable between a closed position with the valve head being in contact with the valve seat and an open position with the valve head being spaced-apart from the valve seat and the valve stem being moved inwardly into the cylinder head by the actuation mechanism, the actuation mechanism operating each valve through a cycle in which the valve is in a closed position longer than in the open position, the valve guide having an upper portion extending upwardly out of the cylinder head and having a cylindrical outer wall having an axis which is coaxial with the axis of the valve stem, a pneumatic valve return comprising:

a valve return body having a cylindrical bore with a cylindrical interior surface coaxial with said valve stem and having a lower support end for engaging said cylinder head to support said return body and for sealingly receiving said valve stem to form a closed lower end of said bore, said support end having a valve guide recess formed therein for receiving the upper portion of the valve guide with said return body engaging at least a portion of the outer walls of the valve guide in said recess to maintain said return body in a position with said bore coaxial with said valve stem, said return body having an upper access end providing an opening into said bore to permit the actuation mechanism to engage the valve stem;

a valve return piston slidably and sealably fitted in said cylindrical bore, said piston in said bore defining a chamber between said piston and said support end of said return body;

means for sealably attaching said piston to said valve stem so that said piston is operable to move with said valve stem between a first position with the valve being closed and with said piston being spaced-apart from said closed lower end of said bore and a second position with said valve being open;

a source of pressurized gas at a selected pressure;

a conduit means for introducing said pressurized gas into said chamber;

inlet means in said cylindrical interior surface of said bore for introducing pressurized gas from said conduit into said chamber at a position where said piston closes said inlet when said piston moves partially toward said second position so that said piston substantially prevents fluid flow through said inlet;

a restriction in said conduit means for preventing rapid fluid escape when said piston moves toward said second position but has not yet closed said inlet, said conduit means supplying gas to said chamber through said restriction when the pressure of the gas is less than said selected pressure and said inlet is open;

whereby, said pressurized gas in said chamber exerts a force at all times on said piston to urge piston towards the first position to close the valve, the gas in said chamber is replenished when said valve is in the closed position to at least approximately said selected pressure, and, when said piston moves toward the second position, said gas is compressed and said force is increased.

9. The pneumatic valve return of claim 8 wherein the ratio between the effective area of said piston and the flow area of said restriction is greater than about 500:1.

10. The pneumatic valve return of claim 8 wherein said means for attaching said piston to said valve stem comprises:

a downwardly-tapered bore extending through said piston for receiving said valve stem and defining a tapered annular space about said valve stem;

a split-ring keeper having two halves matingly fitted into said tapered annular space and being forcefully inserted therein to secure the valve stem to said piston; and a seal disposed below said keeper to seal between said valve stem and said piston.

11. The pneumatic valve return of claim 8 further comprising means for collecting engine oil and passageway for conveying the oil to said valve stem above said valve guide.

12. The pneumatic valve return of claim 11 wherein said oil collection means comprises a trough formed on the outside of said return body at a height above the valve guide and said passageway means comprises an oil flow space around said valve guide in said valve guide recess for permitting oil flow to said valve stem and a passageway through said return body extending from said trough to said oil flow space.

13. The pneumatic valve return of claim 11 wherein said passageway means comprises an annular oil flow area in said return body at said valve guide recess, an oil flow passageway in said valve body from said trough to said annular oil flow area, and a valve guide oil flow passageway extending from said oil flow area through said valve guide to said valve stem in said valve guide.

14. In a reciprocating piston internal combustion engine having a cylinder head and intake and exhaust valves operated by a cam-driven actuation mechanism, each valve having a valve head for engaging a valve seat in the cylinder head and a valve stem attached to the valve head and extending generally upwardly through and out of the cylinder head to be engaged by the actuation mechanism, the valve stem being supported for reciprocating motion by a valve guide in the cylinder head so that the valve is movable between a closed position with the valve head being in contact with the valve seat and an open position with the valve head being spaced-apart from the valve seat and the valve stem being moved inwardly into the cylinder head by the actuation mechanism, the actuation mechanism operating each valve through a cycle in which the valve is in the closed position longer than it is in the open position, the valve guide having an upper portion extending upwardly out of the cylinder head and having a cylindrical outer wall having an axis which is coaxial with the axis of the valve stem, a pneumatic valve return comprising:

a valve return body having a cylindrical bore with a cylindrical wall coaxial with said valve stem and having a lower support end for engaging said cylinder head to support said return body and for sealingly receiving said valve stem to form a closed lower end of said bore, said support end having a valve guide recess formed therein for receiving the upper portion of the valve guide with said return body engaging at least a portion of the outer walls of the valve guide in said recess to maintain said return body in a position with said bore coaxial with said valve stem, said closed lower end of said bore having a return body protrusion generally centered about the valve stem to define an annular space about said protrusion in said bore, said return body having an upper access end providing an opening into said bore to permit the actuation mechanism to engage the valve stem;

a valve return piston having an underside and a cylindrical side wall slidably and sealably fitted in said cylindrical bore and having a downwardly extending piston skirt extending from said underside to form an extension of said side wall and a piston recess in the underside of said piston, said piston in said bore defining a chamber with said piston recess being operable to receive said return body protrusion and said annular space in said bore being operable to receive said piston skirt, means for sealably attaching said piston to said valve stem so that said piston is operable to move with said valve stem between a first position with the valve being closed and with said piston being spaced-apart from said closed lower end of said bore and a second position with said valve being open and with said piston skirt being received into said annular space;

a source of pressurized gas at a selected pressure;

a conduit means for introducing said pressurized gas into said chamber;

inlet means in said cylindrical wall of said bore for introducing pressurized gas into said chamber at said annular space so that said extension of said side wall provided by said piston skirt closes said inlet when said piston moves partially toward said second position to substantially prevent fluid flow;

a restriction in said conduit means for preventing rapid fluid escape when said piston moves toward said second position but has not yet closed said inlet, said conduit means supplying gas to said chamber through said restriction when the pressure of the gas in less than said selected pressure and said inlet is open;

whereby, said pressurized gas in said chamber exerts a force at all times on said piston to urge piston towards the first position to close the valve, the gas in said chamber is replenished when said valve is in the closed position to at least approximately said selected pressure and, when said piston moves toward the second position, said gas is compressed and said force is increased.

15. The pneumatic valve return of claim 14 wherein the ratio between the effective area of said piston and the flow area of said restriction is greater than about 500:1.

16. The pneumatic valve return of claim 14 wherein said means for attaching said piston to said valve stem comprises:

a downwardly-taped bore extending through said piston for receiving said valve stem and defining a tapered annular space about said valve stem;

a split-ring keeper having two halves matingly fitted into said tapered annular space and being forcefully inserted therein to secure the valve stem to said piston; and a seal disposed below said keeper to seal between said valve stem and said piston.

17. The pneumatic valve return of claim 14 further comprising means for collecting engine oil and a passageway means for conveying the oil to said valve stem above said valve guide.

18. The pneumatic valve return of claim 17 wherein the outside of said return body is cylindrically shaped and said oil collection means comprises an annular trough formed on the outside of said return body above the valve guide an said passageway comprises an oil flow space around said valve guide in said valve guide recess for permitting oil flow to said valve stem, and a passageway in said return body extending from said trough to said oil flow space.

19. The pneumatic valve return of claim 17 wherein said passageway comprises an annular oil flow area in said return body at said valve guide recess, an oil flow passageway in said valve body from said trough to said annular oil flow area and a valve guide oil flow passageway extending from said oil flow area through said valve guide to said valve stem in said valve guide.

* * * * *